US005428936A

United States Patent [19]

Roth

[11] Patent Number: 5,428,936

[45] Date of Patent: Jul. 4, 1995

[54] SUSPENSION SYSTEM FOR CONCRETE STRUCTURES

[76] Inventor: Steven A. Roth, 2781 Danville Blvd., Alamo, Calif. 94507

[21] Appl. No.: 103,050

[22] Filed: Jul. 28, 1993

[51] Int. Cl.[6] ..... E04B 1/38; E04G 21/02

[52] U.S. Cl. ..... 52/704; 52/699; 52/745.21; 248/327

[58] Field of Search ..... 52/745.21, 699, 704, 52/705, 326, 334, 745.05, 741.1; 248/59, 327, 610, 613

[56] References Cited

U.S. PATENT DOCUMENTS

| | | | |
|---|---|---|---|
| 1,088,290 | 2/1914 | McAllister et al. . | |
| 3,372,523 | 3/1968 | Hall, Jr. | 52/699 |
| 3,405,497 | 10/1968 | McNair . | |
| 3,800,490 | 4/1974 | Conte | 52/334 |
| 4,083,161 | 4/1978 | Moen | 52/699 |
| 4,325,178 | 4/1982 | Pruehs . | |
| 4,445,303 | 5/1984 | Judkins . | |
| 4,854,086 | 8/1989 | Kubsh et al. . | |
| 5,205,690 | 4/1993 | Roth . | |

FOREIGN PATENT DOCUMENTS 1132793 3/1957 France .

OTHER PUBLICATIONS

Kin-Line, Inc., Oakland, Calif.—Item No. 276 on p. 89 of 1986 Catalog.

ITW Ramset/Red Head, Wood Dale, Ill., p. A42 of 1992 Publication.

*Primary Examiner*—Michael Safavi

*Attorney, Agent, or Firm*—Thomas R. Lampe

[57] ABSTRACT

An insert for attaching at least one object to a concrete structure includes an insert element in the form of a plate defining an aperture. An elongated connector shaft is positioned in the plate and extends through the plate. The elongated connector shaft is threaded along at least portion of the length thereof. An anchor element is affixed to the elongated shaft for embedment in concrete when the insert apparatus is attached to a concrete structure. The plate is secured between two female connectors threadedly engaged with the elongated connector shaft. The outermost female connector can be unthreaded from the elongated connector shaft even after the concrete has hardened.

5 Claims, 5 Drawing Sheets

SUSPENSION SYSTEM FOR CONCRETE STRUCTURES

TECHNICAL FIELD

This invention relates to an apparatus and a method for suspending one or more objects from a concrete structure. The invention is particularly applicable to connect objects to concrete ceilings.

BACKGROUND ART

It is well known to employ concrete inserts to connect items to concrete structures after the concrete has been poured and hardened. Typically, an insert is embedded in a concrete ceiling so that pipe hangers or other objects may be connected to the ceiling by the insert after the concrete hardens.

A variety of metal concrete inserts are utilized in the prior art. Some inserts employ generally U-shaped sheet metal pieces to support rods which extend down through the ceiling. Such an arrangement is shown for example in my U.S. Pat. No. 5,205,690, issued Apr. 27, 1993. An insert employing a U-shaped plate also is illustrated as Item No. 276 on page 89 of the 1986 catalog published by Kin-Line, Inc., of Oakland, Calif. In the latter, an insert includes a U-shaped sheet metal piece which incorporates legs terminating in flanges that lie in a common plane and a bridge between the legs having a hole through which a threaded fastener is inserted. An internally threaded coupling is positioned between the legs of the U-shaped piece to butt against the bridge and a threaded fastener is screwed into the internal threaded cavity of the coupling and locked into place with a nut that abuts the bridge. The insert is constructed so that the threaded coupling is the same length as the legs of the U-shaped piece whereby the opening to the threaded coupling is in the plane of the concrete ceiling and the open end of the coupling is exposed at the bottom of a ceiling so that a threaded rod may be placed therein to support a pipe hanger or other object. U.S. Pat. No. 4,445,303, issued May 1, 1984, also discloses a concrete insert with a U-shaped component.

Inserts employing U-shaped members have certain drawbacks. For example, since the insert coupler terminates at the bottom of the concrete structure, adjustment and alignment are difficult during installation. And, of course, since the lower-most connector is embedded in the concrete, it cannot be removed or adjusted after the concrete hardens. Furthermore, U-shaped insert components can interfere with the flow of concrete and create voids in the vicinity of the insert which can adversely affect strength and performance. Also, the use of a U-shaped element dictates a minimum concrete depth. That is, the depth of the poured concrete structure must exceed the height of the insert, creating a situation which is not always desirable.

It is also known to employ deck inserts which employ a flat plate threadedly engaged with a rod which extends completely through the plate and through a hole in the metal decking or other support for the concrete. Such an arrangement, for example, is Item No. 293 on page 89 of the 1986 catalog published by Kin-Line, Inc. of Oakland, Calif. Such an approach has limited applicability and some inherent limitations. For example, when the anchor or upper end of the rod attached to the plate is moved up or down the lower end of the rod, by necessity, also moves up and down. This greatly limits the applicability of the device and necessitates the use of different rod lengths for different applications. For example, it may be desirable to have the bent upper end or anchor end of the rod project well up into the concrete and this may very well shorten the lower effective length of the rod to an undesirable degree.

Applicant is also aware of the following patent documents which are of record in applicant's U.S. Pat. No. 5,205,690: U.S. Pat. No. 1,088,290, issued Feb. 24, 1914, U.S. Pat. No. 3,405,497, issued Oct. 15, 1968, U.S. Pat. No. 4,325,178, issued Apr. 20, 1982, U.S. Pat. No. 4,854,086, issued Aug. 8, 1989, and French Patent No. 1132793 having an effective date of Nov. 5, 1956.

Also representative of the prior art are the inserts shown on page 155 of the B-Line System Inc. catalog made available by B-Line Systems Inc. of Highland, Ill. Applicant is also aware of the Ramset/Red Head steel deck insert made available by ITW of Wood Dale, Ill. and shown on page A42 of a 1992 publication designated Anchor Systems by that company.

DISCLOSURE OF INVENTION

The present invention relates to a concrete insert apparatus which is of relatively simple, inexpensive construction but which avoids the problems noted above with respect to the prior art. The apparatus of the present system can be utilized in a wide variety of applications.

The insert apparatus of the present invention will not substantially impede the flow of wet concrete, so the strength and integrity of the hardened, completed structure is not compromised. The upper portion of the insert maintains a low profile and unnecessary concrete need not be expended to create the concrete structure. With the arrangement of the present invention, the anchor or upper end of the rod employed therein may be adjusted up or down without a similar movement taking place at the bottom of the insert.

In addition, a removable lower component of the insert apparatus projects downwardly from the concrete and is not in substantial engagement with the concrete. This allows for ready proper alignment of the insert apparatus relative to the concrete structure as well as adjustment or even removal of the lowermost insert apparatus component (which is in the form of a threaded female member) even after the concrete has hardened. The apparatus of the present invention is applicable to both form pouring and metal decking procedures for creating concrete structures.

The insert apparatus of the present invention is for use in combination with a concrete structure having a bottom surface and an upper surface, the insert apparatus for attachment to the concrete structure to connect at least one object to the concrete structure with said at least one object being supported by the concrete structure and depending therefrom below the bottom surface.

The insert apparatus includes an insert element at least partially comprising a plate defining an aperture, the plate having opposed first and second sides. The first side of the plate is in engagement with a concrete structure when the insert apparatus is attached to a concrete structure.

An elongated connector shaft is positioned in the plate aperture and extends through the plate. The elongated connector shaft is threaded along at least a portion of the length thereof and has an upper end and a lower end.

An anchor element is affixed to the elongated shaft upper end and extends laterally outwardly from the elongated connector shaft for embedment in concrete when the insert apparatus is attached to a concrete structure.

A first female connector is threadedly engaged with the elongated connector shaft on the first side of the plate.

A second female connector is threadedly engaged with the elongated connector shaft on the second side of the plate, the first female connector being embedded in concrete when the insert apparatus is attached to a concrete structure and the second female connector extending downwardly from the bottom surface of the concrete structure unembedded in the concrete of a concrete structure, and moveable relative to the elongated connector shaft, the insert element, and the concrete upon application of outside force to the second female connector.

The present invention also encompasses a method of attaching an insert to a concrete structure, the insert for hanging at least one object from the concrete structure. The insert includes a plate defining an aperture and a threaded elongated connector shaft having an anchor element at one end and positioned in the plate aperture.

The method includes the step of locating a support for concrete at a predetermined location. A hole is formed in the support.

The plate is positioned on the support in engagement with the support over a predetermined area surrounding the hole.

The elongated connector shaft is supported on the plate by threadedly engaging the elongated connector shaft with a female connector positioned on the plate. The elongated connector shaft is adjusted lengthwise relative to the plate and relative to the support for the concrete until the anchor element is located a predetermined distance above the plate.

A second female connector is threaded onto the elongated connector shaft and the plate is tightened between the first and second female connectors while maintaining the anchor element at the predetermined distance above the plate.

Wet concrete is poured on the support to a depth exceeding the predetermined distance whereby the anchor is embedded in the concrete and the concrete is hardened on the support while the anchor remains embedded in the concrete.

The second female connector is maintained substantially out of engagement with the concrete during the pouring and hardening steps whereby the second female connector may be unthreaded relative to the elongated connector shaft upon hardening of the concrete.

Other features, advantages, and objects of the present invention will become apparent with reference to the following description and accompanying drawings.

MODES FOR CARRYING OUT THE INVENTION

Figure 1:
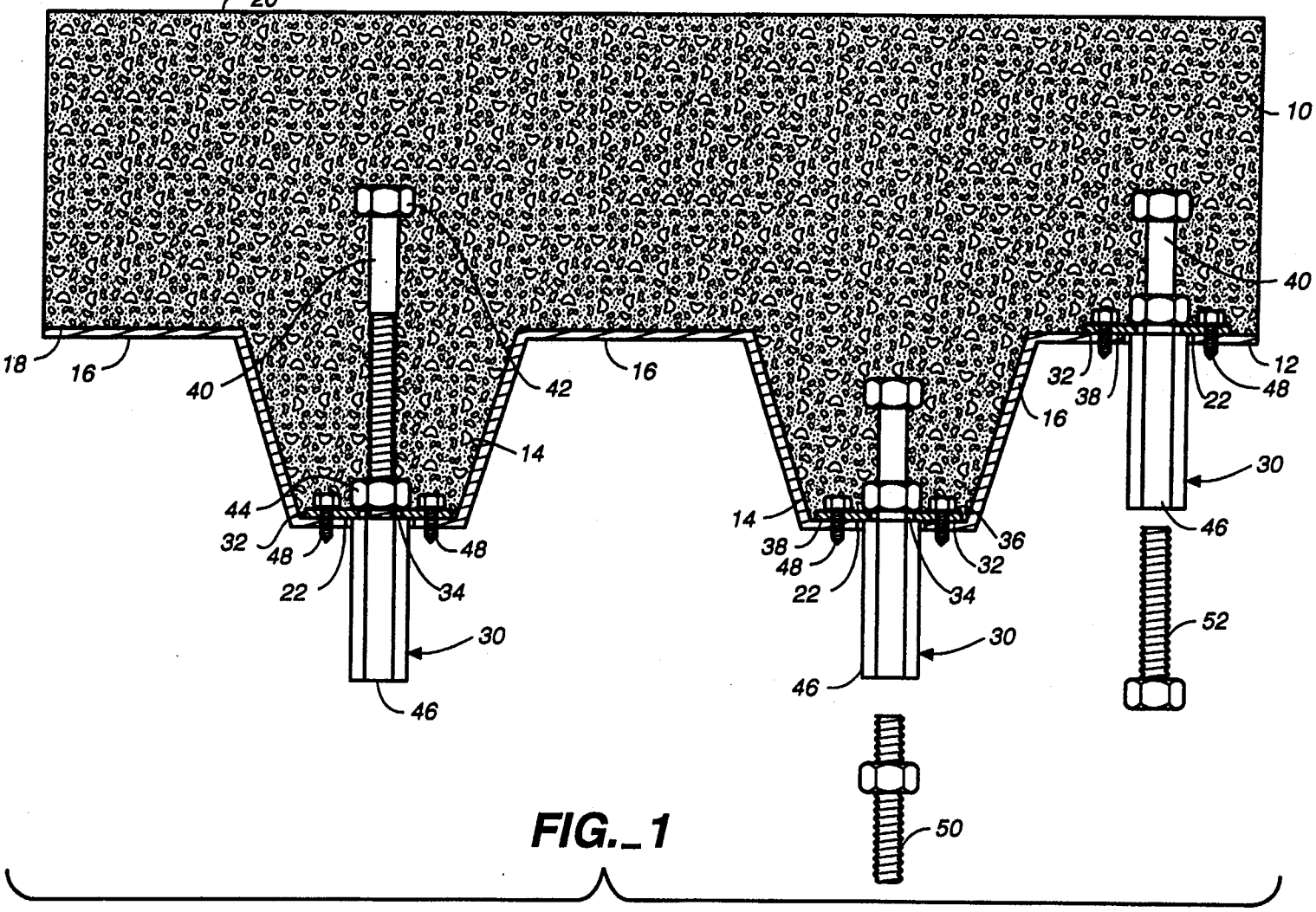
FIG. 1 is a cross-sectional, side view taken through a concrete structure supported by metal decking and illustrating insert apparatus constructed in accordance with the teachings of the present invention at three different locations on the structure and decking.

Referring now to FIG. 1, insert apparatus constructed in accordance with the teachings of the present invention is shown installed at three locations in a concrete structure, more particularly a concrete ceiling 10 supported by metal decking 12. As is conventional, the metal decking 12 is comprised of a series of alternating channels defining spaced troughs 14 interconnected by ridge members 16. During formation of the concrete structure, the concrete is poured onto the metal decking, the concrete structure having a bottom surface 18 and a top surface 20.

In the arrangement illustrated, holes 22 have been punched or drilled in the metal decking at the locations where insert apparatus of the present invention are to be positioned. In FIG. 1, two of the holes are located at the decking troughs and one hole is located at a ridge member.

The insert apparatus disclosed in FIG. 1 is designated by reference numeral 30. Each insert apparatus illustrated in FIG. 1 includes an insert element in the form of a flat plate 32 defining an aperture 34. The plate has a first side 36 in engagement with concrete structure 10 and a second side 38 positioned directly on metal decking 12. Plate 32 is of uniform thickness and the opposed first and second sides 36, 38 thereof are substantially flat.

An elongated connector shaft 40 is located in the plate aperture 34 and extends through the plate. Elongated connector shaft 40 is threaded over the lower portion of the length thereof as shown in the left-most insert apparatus 30 illustrated in FIG. 1.

An anchor element 42 is affixed to the elongated shaft upper end and extends laterally outwardly from the elongated connector shaft for embedment in concrete when the insert apparatus is attached to a concrete structure. In the embodiment illustrated in FIG. 1, the anchor element is in the form of an enlarged bolt head having a polygonal shaped periphery.

A first female connector in the form of a nut 44 is threadedly engaged with the elongated connector shaft 40 on the first side 36 of plate 32.

A second female connector in the form of an elongated, internally threaded coupler 46 having a polygonal shaped periphery is threadedly engaged with the elongated support shaft at the lower end thereof. Plate 32 is sandwiched between the first and second female connectors 44, 46.

It should be noted that with respect to all three of the inserts shown in FIG. 1, the aperture 34 of plate 32 is generally aligned with a hole 22 formed in the associated portion of metal decking 12. The elongated support shaft passes through both aperture 34 and hole 22 into second female connector 46. The insert is placed at its desired location relative to the metal decking prior to pouring of the concrete of concrete structure 10. The installer can readily raise or lower the height of anchor element 42 merely by screwing or unscrewing the connector shaft 40 relative to second female connector 46.

When the connector shaft 40 has been adjusted to its desired effective length, the nut 44 will be tightened down to maintain such position. It will be noted that plate 32 is attached to metal decking 12 by metal screws 48. This will prevent rotation of the plate. Because the second female connector or coupler 46 is disposed below metal decking 12 it may be easily grasped to ensure that proper alignment and positioning of the insert is accomplished.

Now the concrete can be poured into position on the metal decking to form the concrete structure 10. It will be noted that the insert does not substantially impede concrete flow or promote the formation of voids in the concrete in the vicinity of the insert.

The first female connector or nut 44 is larger than the plate aperture 34 and is cooperable with the plate to cover hole 22 in the metal decking. This will prevent any substantial direct engagement between the concrete and the coupler 46 from taking place. The second female connector 46 is thus free to be unthreaded from connector shaft 40 to either be adjusted relative thereto or to be removed therefrom. It may be seen from the above that the insert apparatus of the present invention allows the length of the complete insert to be adjusted independently both at the top and at the bottom.

The lower end of coupler 46 is free to receive another threaded element, assuming that the connector shaft 40 extends part way therethrough and does not occupy the entire interior of the coupler.

In FIG. 1, a threaded shaft 50 having a nut thereon is shown just prior to placement within coupler 46 of one of the illustrated inserts and a bolt 52 is shown preparatory to threadedly engaging another one of the insert couplers.

Figure 2:
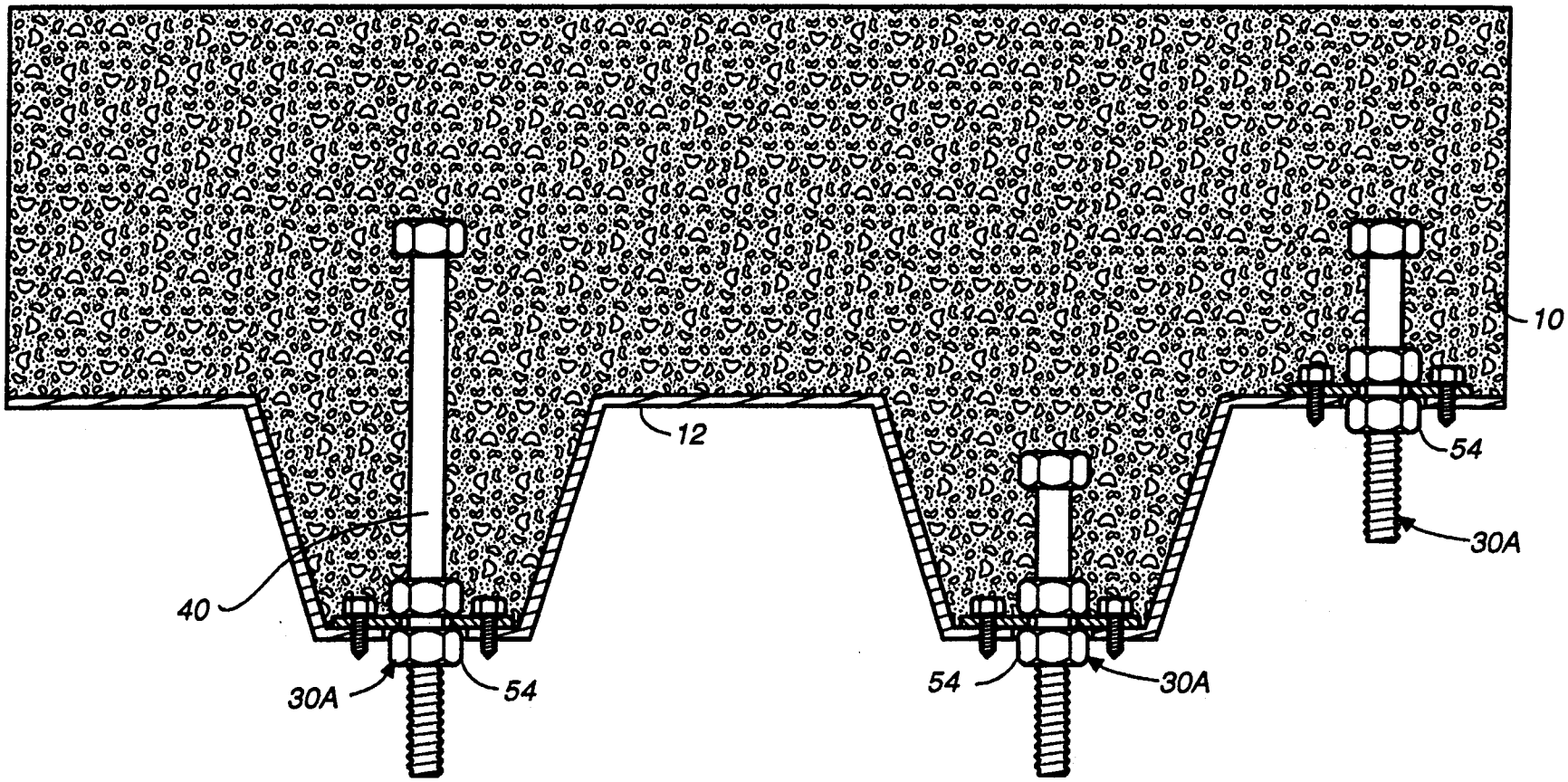
FIG. 2 is a view similar to FIG. 1, but illustrating an alternative embodiment at three locations relative to the concrete structure and decking.
Figure 9:
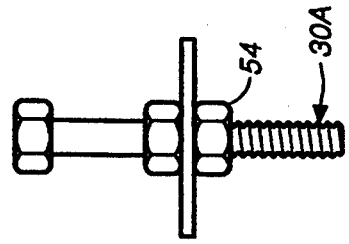
FIG. 9 is a side, elevational view of a connector of the type shown in FIG. 2, prior to installation in a concrete structure.

Referring now to FIGS. 2 and 9, the insert apparatus 30A shown therein differs from insert apparatus 30 in that the second or lowermost female connector is in the form of a nut 54 threaded about the connector shaft 40 of the insert. With this arrangement, the lower end of the connector shaft 40 may be utilized to receive a separate connector or object since the connector shaft extends below the second female connector. FIG. 2 illustrates the use of different connector shaft lengths, the left-most connector shaft 40 being longer than the two illustrated connector shafts in the right side of the figure.

Figure 3:
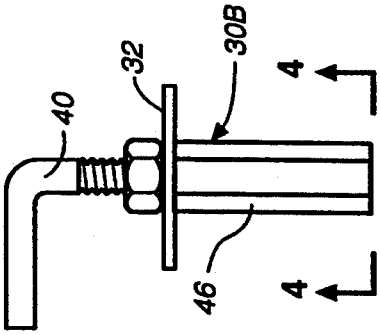
FIG. 3 is a side, elevational view of another embodiment of the present insert apparatus.
Figure 4:
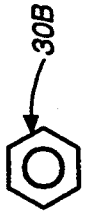
FIG. 4 is an end view of the lower female connector of the apparatus of FIG. 3 as taken along the line 4—4 in FIG. 3.

Insert 30B illustrated in FIGS. 3 and 4 differs from insert 30 shown in FIG. 1 by virtue of the fact that the anchor element of the apparatus is formed by bending the shaft 40. That is, there is no bolt head employed in this embodiment.

Figure 5:
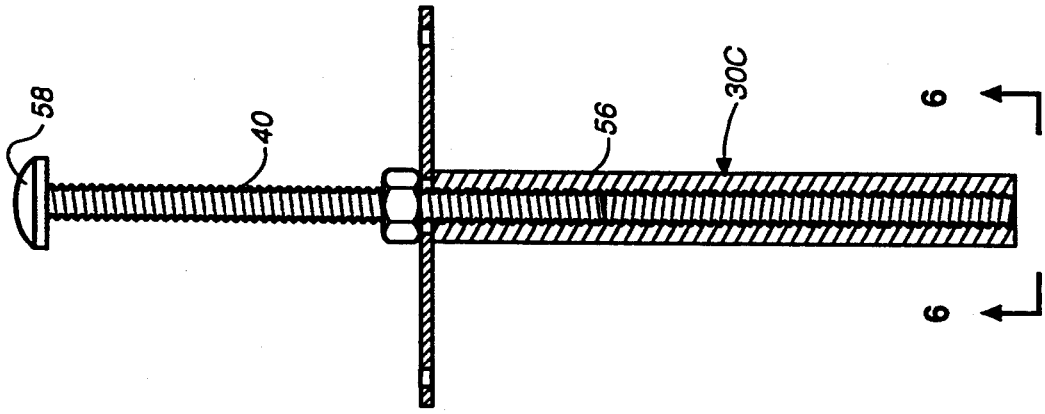
FIG. 5 is a cross-sectional, side view of yet another embodiment of the apparatus.
Figure 6:
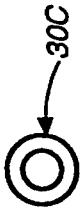
FIG. 6 is an end view of the lower female connector as taken along the line 6—6 in FIG. 5.

In FIGS. 5 and 6, insert apparatus 30C includes a long sleeve-like member 56 as the second female connector. The connector shaft 40 extends part way down through the sleeve and is engaged by internal threads of the sleeve. The anchor element in this instance is a rounded cap 58.

Figure 7:
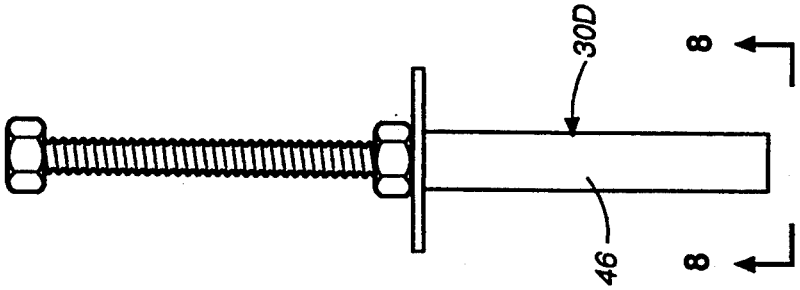
FIG. 7 is a side, elevational view of still another embodiment of the apparatus.
Figure 8:
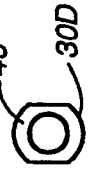
FIG. 8 is an end view taken along the line 8—8 in FIG. 7 of the lower female connector.

In FIGS. 7 and 8, the insert apparatus 30D employs as the second female connector a threaded coupler 46 which is rounded on two opposed sides and flattened on two opposed sides.

Figure 10:
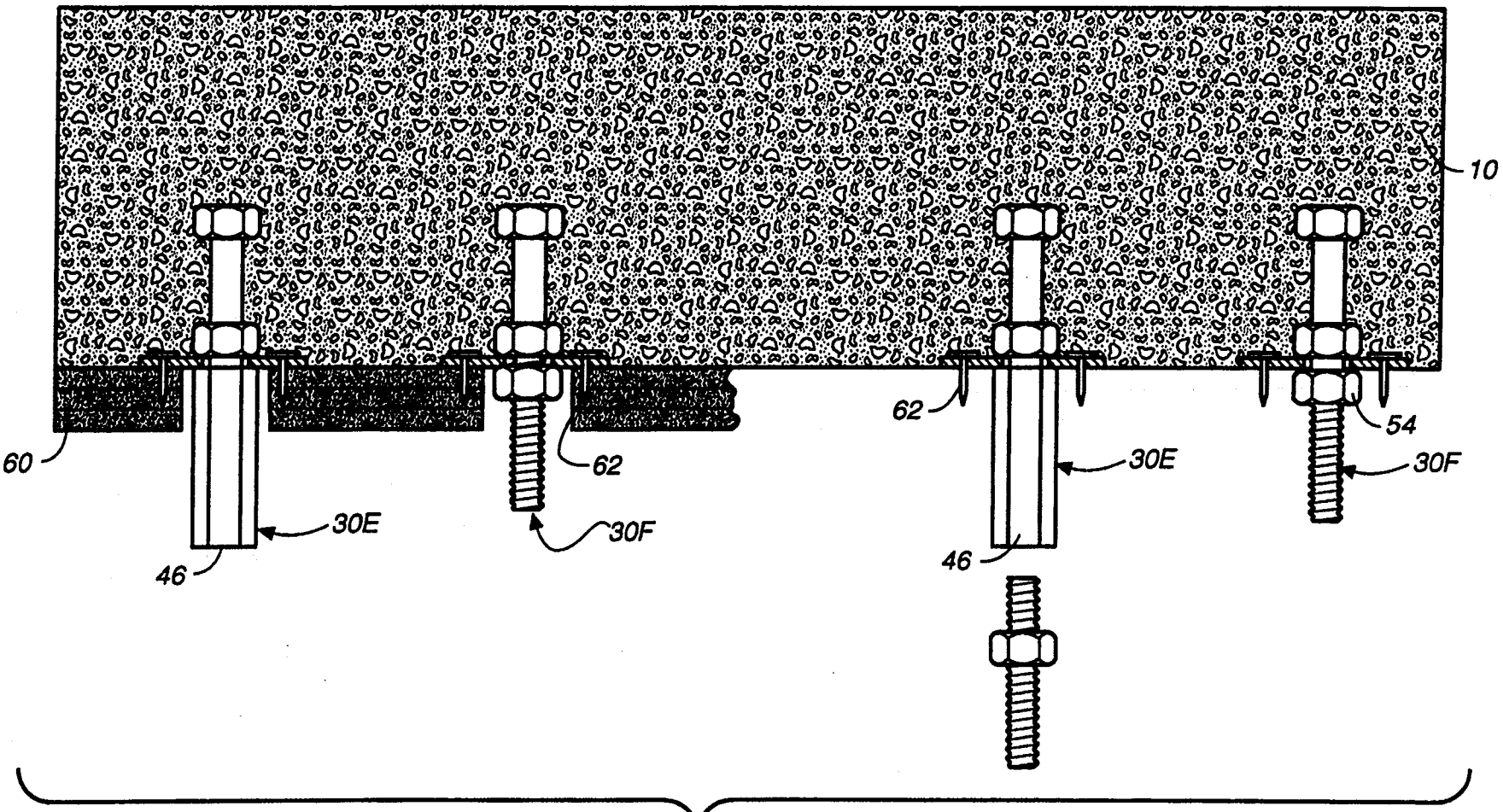
FIG. 10 is a cross-sectional, side view of a concrete structure with a portion thereof having a concrete form in engagement therewith and illustrating alternative embodiments of the apparatus of the present invention attached to the concrete structure.

In FIG. 10, the concrete structure 10 has been form poured. For illustrative purposes, a section of the form 60 is shown at the left of the figure. It will be appreciated that the form 60 normally is removed after the concrete of the concrete structure 10 has hardened.

Here the inserts are nailed to the form by nails 62. After the concrete has hardened, the form is pulled away from the concrete, leaving the pointed ends of the nails exposed as shown on the two right-most inserts 30E, 30F illustrated in FIG. 10. If desired, these nail tips can be cut or broken off after removal of the form 60. The two illustrated inserts 30E employ couplers 46 of the type utilized in the FIG. 1 embodiment, while the two inserts 30F employ nuts 54 to allow addition of another female connector to the shaft of the insert if desired.

Figure 11:
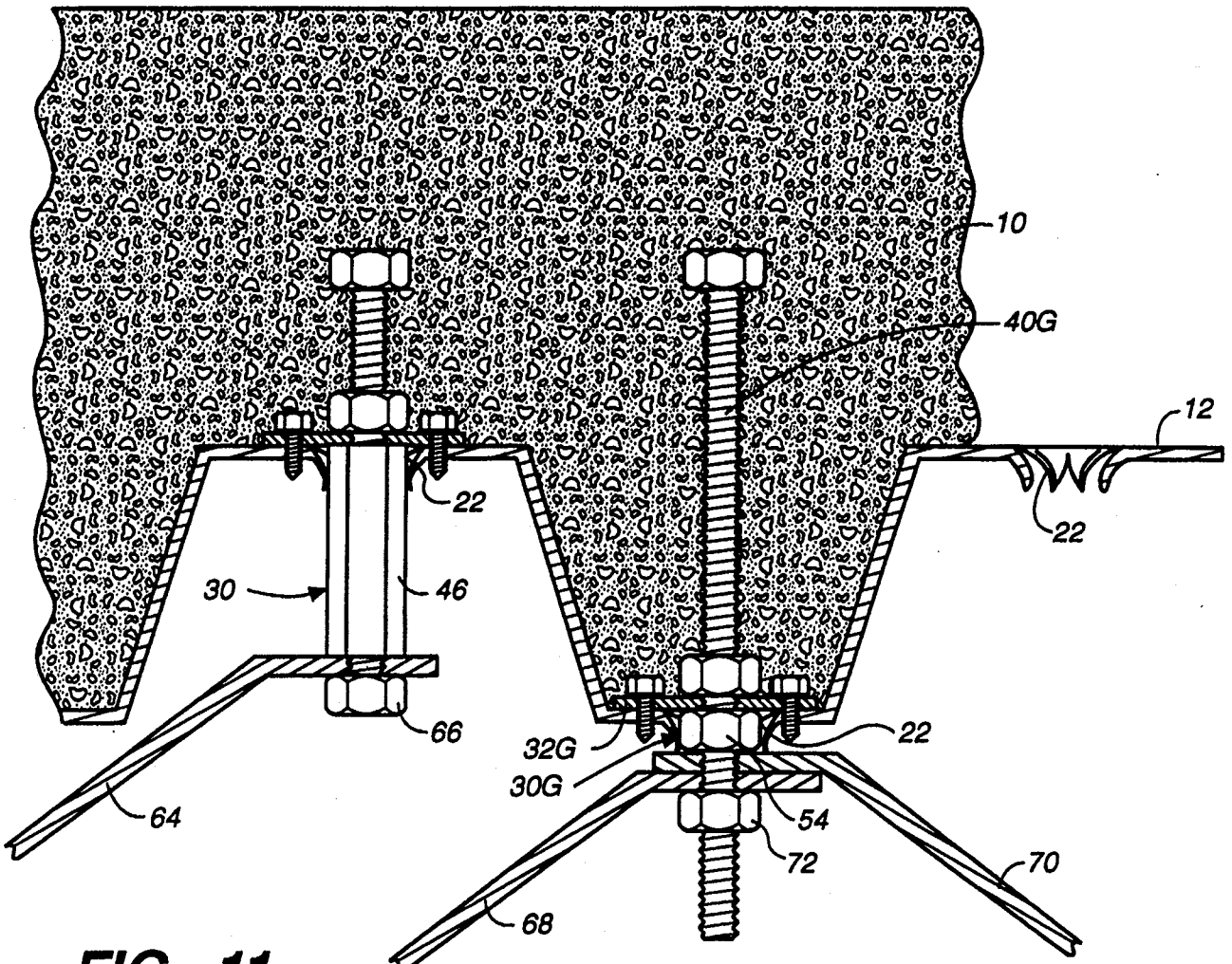
FIG. 11 is a cross-sectional, side view of a concrete structure on metal decking showing apparatus constructed in accordance with the teachings of the present invention affixed to the concrete and the decking at two locations.

FIG. 11 provides a more detailed view of concrete structure 10 supported by metal decking 12. Here holes 22 have been formed in the metal decking by piercing same.

Insert apparatus 30 of the type shown in FIG. 1 is illustrated holding an object 64. Securement of the object 64 is accomplished by a bolt 66 screwed into coupler 46.

In the other insert apparatus 30G, the connector shaft 40G is threaded along its entire length, threadedly engaged with plate 32G, and supports two objects 68, 70 at its lower end. The objects 68, 70 are secured between the second female connector in the form of nut 54 and another nut 72.

It will be appreciated that modifications other than those specifically illustrated and described herein may be made to the invention without departing from the spirit or scope thereof. For example, a single plate may have a plurality of apertures formed therein to accommodate a plurality of connector shafts and related connectors.

I claim:

1. Insert apparatus in combination with a concrete structure having a bottom surface and an upper surface, said insert apparatus partially embedded in and attached to said concrete structure to connect at least one object to said concrete structure with said at least one object being supported by said concrete structure and depending therefrom below said bottom surface, said insert apparatus comprising, in combination:

an insert element comprising a flat plate defining an aperture, said plate being of substantially uniform thickness and having opposed first and second substantially flat sides, the first side of said plate being in abutting engagement with said concrete structure with said concrete structure disposed thereabove and the second side thereof out of engagement with said concrete structure;

an elongated connector shaft positioned in said plate aperture and extending through said plate, said elongated connector shaft being threaded along at least a portion of the length thereof and having an upper end and a lower end;

an anchor element affixed to said elongated shaft upper end and extending laterally outwardly from said elongated connector shaft embedded in said concrete structure;

a first female connector threadedly engaged with said elongated connector shaft on the first side of said plate in abutting engagement with the first side of said plate and embedded in said concrete structure; and a second female connector threadedly engaged with said elongated connector shaft on the second side of said plate, said second female connector extending downwardly from the bottom surface of said concrete structure, unembedded in the concrete of said concrete structure, and moveable relative to the elongated connector shaft, the insert element, and said concrete structure upon application of outside rotational force to said second female connector, said second female connector moveable between a first position wherein said second female connector engages said plate to clamp said plate between said first female connector and said second female connector and a second position wherein said second female connector is threadedly disengaged from the elongated connector shaft, said second female connector being selectively adjustable on said elongated connector shaft between said first and second positions, said concrete structure being positioned on metal decking defining a hole, said elongated support shaft located within the hole, said first female connector being larger than the aperture defined by the plate and cooperable with said plate to cover said hole, and said plate being in engagement with said metal decking.

2. The insert apparatus according to claim 1 additionally comprising mechanical fastener means attaching said insert element to said metal decking.

3. The insert apparatus according to claim 2 wherein said mechanical fastener means comprises at least one screw extending through said plate and said decking securing said plate to said decking.

4. The insert apparatus according to claim 1 wherein said second female connector comprises an elongated, internally threaded coupler, said elongated connector shaft being threadedly engaged with said elongated, internally threaded coupler and extending partially through said elongated, internally threaded coupler when said second female connector is located between said first position and said second position.

5. A method of attaching insert apparatus to a concrete structure, said insert apparatus for hanging at least one object from said concrete structure and including an insert element comprising a plate defining an aperture and a threaded elongated connector shaft having an anchor element at one end and positioned in said aperture, said plate being of substantially uniform thickness and having opposed first and second substantially flat sides, said method comprising the steps of:

locating a support for concrete at a predetermined location; forming a hole in said support;

positioning said plate directly on said support with the first side of the plate in abutting engagement with the support over the complete area of the first side of the plate and over a predetermined area surrounding said hole and with the plate aperture over the hole;

supporting the elongated connector shaft on the plate by threadedly engaging the elongated connector shaft with a first female connector positioned on said plate and in abutting engagement with said plate;

adjusting the elongated connector shaft lengthwise relative to the plate, relative to the first female connector, and relative to the support for the concrete until the anchor element is located a predetermined distance above said plate and the end of the elongated connector shaft remote from the anchor element projects through the support hole and plate aperture below the concrete;

threading a second female connector on to said elongated connector shaft and bringing the second female connector into abutting enlargement with said plate to clamp said plate between said first and second female connectors to maintain the anchor element at said predetermined distance above said plate and the end of the elongated connector shaft remote from the anchor element below the concrete;

pouring wet concrete on said support to a depth exceeding said predetermined distance whereby said first female connector and said anchor are embedded in said concrete with said plate first side in abutting engagement with said wet concrete and said plate second side substantially out of engagement with said concrete;

hardening said concrete on said support while said anchor and said first female connector are embedded in the concrete; and maintaining said second female connector substantially out of engagement with said concrete during said pouring and hardening steps whereby said second female member may be unthreaded relative to said elongated connector shaft after hardening of said concrete between a first position wherein said second female connector engages said plate to clamp said plate between said first female connector and said second female connector and a second position wherein said second female connector is threadedly disengaged from the elongated connector shaft.

* * * * *